US009447671B2

(12) United States Patent
Nguyen et al.

(10) Patent No.: US 9,447,671 B2
(45) Date of Patent: Sep. 20, 2016

(54) ADJUSTABLE ISOLATION SLEEVE ASSEMBLY FOR WELL STIMULATION THROUGH PRODUCTION TUBING

(71) Applicant: GE Oil & Gas Pressure Control LP, Houston, TX (US)

(72) Inventors: Khang V. Nguyen, Houston, TX (US); Eugene Allen Borak, Tomball, TX (US); Saurabh Kajaria, Houston, TX (US)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 459 days.

(21) Appl. No.: 13/944,028

(22) Filed: Jul. 17, 2013

(65) Prior Publication Data

US 2014/0020900 A1 Jan. 23, 2014

Related U.S. Application Data

(60) Provisional application No. 61/672,565, filed on Jul. 17, 2012.

(51) Int. Cl.
*E21B 43/26* (2006.01)
*E21B 33/12* (2006.01)

(52) U.S. Cl.
CPC ..... *E21B 43/26* (2013.01); *E21B 33/1208* (2013.01)

(58) Field of Classification Search
None
See application file for complete search history.

(56) References Cited

U.S. PATENT DOCUMENTS

| | | | | |
|---|---|---|---|---|
| 4,076,079 | A | 2/1978 | Herricks et al. | |
| 4,519,633 | A * | 5/1985 | Nichols | E21B 33/043 166/217 |
| 5,819,851 | A | 10/1998 | Dallas | |
| 6,039,120 | A | 3/2000 | Wilkins et al. | |
| 6,364,024 | B1 | 4/2002 | Dallas | |
| 7,308,934 | B2 * | 12/2007 | Swagerty | E21B 43/26 166/177.5 |
| 7,490,666 | B2 | 2/2009 | Swagerty et al. | |
| 7,578,351 | B2 | 8/2009 | Dallas | |
| 7,857,062 | B2 | 12/2010 | Dallas | |
| 2010/0051261 | A1 * | 3/2010 | Koleilat | E21B 33/068 166/177.5 |
| 2011/0155367 | A1 | 6/2011 | Swagerty et al. | |

FOREIGN PATENT DOCUMENTS

WO 2009111434 A2 9/2009

OTHER PUBLICATIONS

PCT Search Report and Written Opinion dated Feb. 27, 2014 from corresponding Application No. PCT/US2013/050910.

* cited by examiner

*Primary Examiner* — Jennifer H Gay
*Assistant Examiner* — Caroline Butcher
(74) *Attorney, Agent, or Firm* — Bracewell LLP; Linda Morgan

(57) ABSTRACT

A fracturing system includes a fracturing spool that mounts onto a wellhead assembly for injecting fracturing fluid into a well beneath the wellhead assembly. An isolation sleeve is included with the fracturing system that couples to the fracturing spool and extends into the wellhead to isolate and protect portions of the wellhead assembly from the fracturing fluid. A seal is between the isolation sleeve and bore of the wellhead assembly, which is threaded to the isolation sleeve. Manipulating the threaded connection between the isolation sleeve and seal selectively positions the isolation sleeve to designated axial positions within the wellhead assembly.

14 Claims, 4 Drawing Sheets

ADJUSTABLE ISOLATION SLEEVE ASSEMBLY FOR WELL STIMULATION THROUGH PRODUCTION TUBING

CROSS REFERENCE TO RELATED APPLICATIONS

This application claims priority to and the benefit of U.S. Provisional Application Ser. No. 61/672,565, filed Jul. 17, 2012, the full disclosure of which is hereby incorporated by reference herein for all purposes.

BACKGROUND OF THE INVENTION

1. Field of the Invention

This disclosure relates in general to an isolation sleeve employed during hydraulic fracturing operations through production tubing to protect the wellhead from the high fracturing pressure, and in particular to a sleeve assembly that is adjustable in length to accommodate variation in different wellhead stack-ups and tolerances.

2. Description of Prior Art

One type of treatment for an oil or gas well is referred to as well fracturing or a well "frac". In a typical tracing operation, an adapter is connected to the upper end of a wellhead member, and high pressure liquid is pumped down the well to create fractures in the earth formation. Proppant material is often included in the fracturing fluid, which enters the fractures to maintain them open alter the high pressure is removed. Hydraulic fracturing is particularly useful for hydrocarbon bearing earth formations with low permeability and adequate porosity, as the entrained hydrocarbons can flow more easily through the fractures created in the earth formation.

Fracing fluid pressure often ranges up to pressures of 8,000 to 9,000 psi; whereas normal wellhead operating pressure may be a few hundred to a few thousand psi. Accordingly, fracing pressures usually exceed pressure ratings of the wellhead and its associated valves. Moreover, additives to the frac fluid, such as the proppant, can be very abrasive and damaging to parts of the wellhead. Isolation sleeves are sometimes used to address the issues of overpressure and fluid erosion. Generally, isolation sleeves seal between an adapter above the wellhead and the casing or tubing extending into the well.

SUMMARY OF THE INVENTION

Disclosed herein are examples of fracturing a wellbore. In one example disclosed is a fracturing assembly for use in a wellhead assembly that includes a fracturing spool that is selectively mounted onto the wellhead assembly, a seal disposed an axial bore in the fracturing spool, and an isolation sleeve. The isolation sleeve has one end in selective communication with a supply of fracturing fluid. A portion of the isolation sleeve extends into a main bore of the wellhead assembly and defines a barrier between the fracturing fluid and components in the wellhead assembly. The isolation sleeve has an outer surface with a threaded portion that engages threads on an inner surface of the sleeve, the threads have a length so that the isolation sleeve is adjustable to axial locations within the main bore. An anti-rotation screw can be included that is radially disposed through a sidewall of the fracturing spool, and has an end inserted into a groove formed in an outer surface of the seal, so that the seal is rotationally affixed to the fracturing spool. Optionally included with this example is a lockdown screw radially disposed through a sidewall of the fracturing spool and in contact with an end of the seal distal from the groove and that exerts a force onto the seal directed towards the groove. The seal can include an annular load ring, an annular elastic compression seal stacked onto the load ring, an annular compression ring stacked onto the compression ring, passages formed axially in sidewalls of the load ring, compression seal, and compression ring, fasteners inserted into the passages and that each have a lower end threaded into the load ring and an upper end in interfering contact with the compression ring. In an embodiment, the wellhead assembly is a first wellhead assembly, and wherein the fracturing spool is selectively mounted on a second wellhead assembly having components at axial locations different from axial locations of components of the first wellhead assembly, and wherein the isolation sleeve is selectively repositioned by rotation and isolates the components in the second wellhead assembly from the fracturing fluid. The wellhead assembly can include a production valve mounted on a tubing spool, and wherein the isolation sleeve extends through the production valve and into the tubing spool. In an example, the isolation sleeve extends past threads in the tubing spool and thereby defines a barrier between the fracturing fluid and the threads in the tubing spool.

Also disclosed herein is a fracturing assembly for use with wellhead assemblies, and that is made up of a fracturing spool that selectively mounts onto the wellhead assemblies and has an axial bore that registers with main bores in each of the wellhead assemblies, and an isolation sleeve in the fracturing spool to isolate fracturing fluid in the isolation sleeve from selected components at an axial location in a one of the wellhead assemblies. The isolation sleeve is adjustable to isolate the fracturing fluid from selected components in another one of the wellhead assemblies and that is at a different axial location. Threads on an outer surface of the isolation sleeve provide axial adjustment of the isolation sleeve in the fracturing spool. Anti-rotation screws can be provided in the fracturing spool for rotationally anchoring the isolation sleeve to the fracturing spool. A seal can be set in an annular space between the isolation sleeve and walls of an axial bore in the fracturing spool, wherein the threads on the isolation sleeve engage threads on the seal so that rotating the isolation sleeve axially adjusts the isolation sleeve to different elevations in a one of the wellhead assemblies on which the fracturing spool is mounted.

A method of fracturing a well is disclosed herein that includes providing a supply of fracturing fluid to a wellhead assembly mounted onto the well, inserting an isolation sleeve into a main bore of the wellhead assembly to isolate components in the wellhead assembly from the fracturing fluid, and adjusting an axial position of the isolation sleeve within the main bore. In an example method, the isolation sleeve is inserted into a second wellhead assembly having components that are lower than the components in the first wellhead assembly. The axial position of the isolation sleeve is adjusted within a main bore of the second wellhead assembly to isolate the components in the second wellhead assembly from the fracturing fluid. Optionally, the isolation sleeve is in a fracturing spool that is mounted onto the wellhead assembly, and a seal is between the isolation sleeve and the fracturing spool.

BRIEF DESCRIPTION OF DRAWINGS

Some of the features and benefits of the present invention having been stated, others will become apparent as the description proceeds when taken in conjunction with the accompanying drawings, in which.

Figure 1:
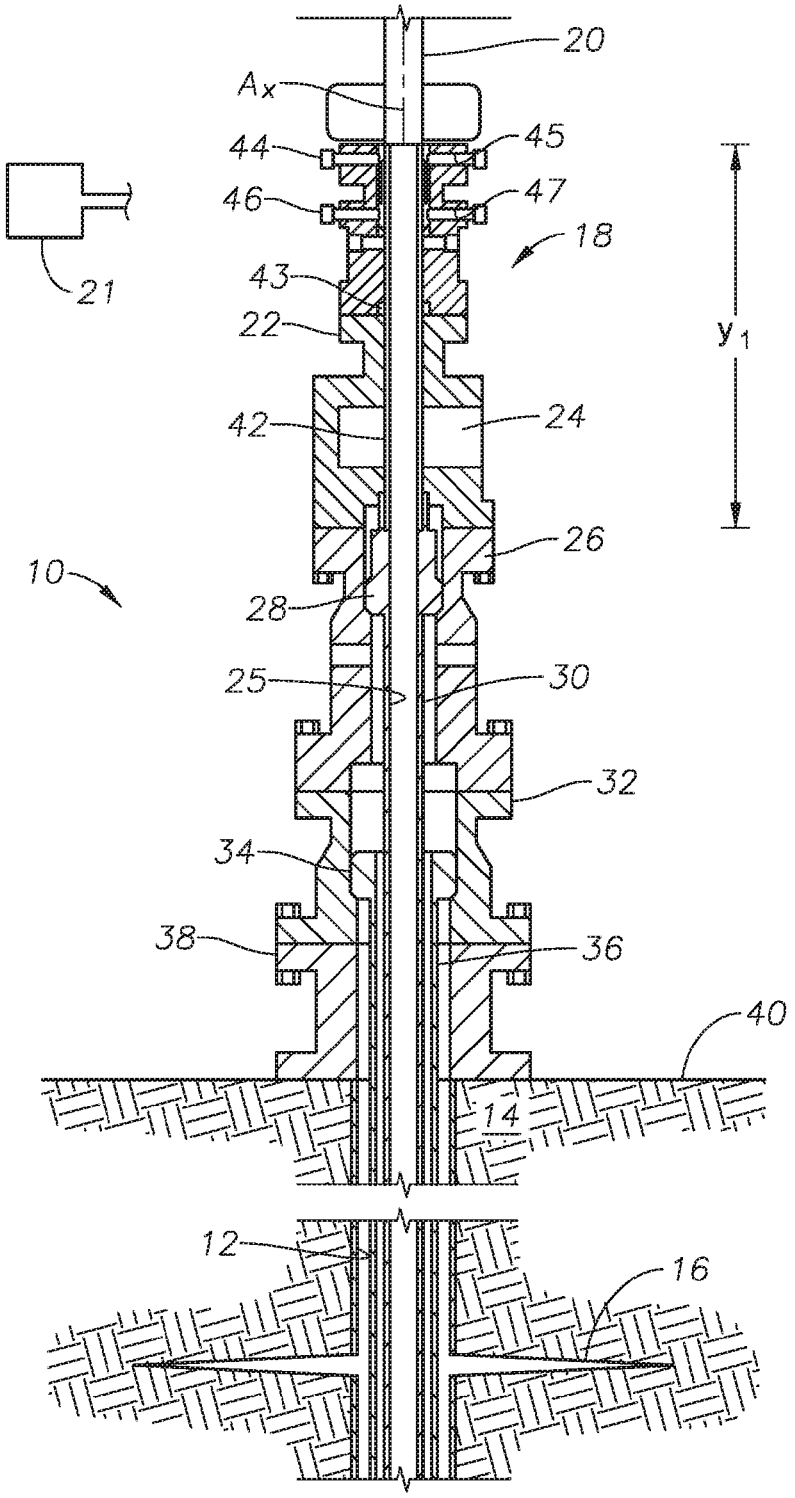
FIG. 1 is a side sectional view of an example embodiment of a fracturing system mounted onto a wellhead assembly in accordance with an embodiment of the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of contraction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example of a wellhead assembly 10 is shown in a side sectional view in FIG. 1. The wellhead assembly 10 is positioned over a wellbore 12 which intersects a subterranean formation 14. The wellhead assembly 10 of FIG. 1 is being used in conjunction with fracturing operations so that fractures 16 may be formed in the formation 14 and that initiate from a wall of the wellborn 12. A fracturing system 17 is shown that includes an annular fracturing spool 18 mounted on an upper end of wellhead assembly 10. A supply line 20 is coupled to the fracturing spool 18, which delivers fracturing fluid to the wellhead assembly 10 from a fluid source 21. The fracturing spool 18 mounts onto a production valve body 22, which is shown having a lateral bore 24 that extends transverse to an axis $A_X$ of the wellhead assembly 10. Lateral bore 24 is intersected by a main bore 25, which projects axially through the wellhead assembly 10. Valve body 22 is shown coaxially mounted onto a tubing spool 26 having an axial space in which a tubing hanger 28 is mounted therein. Further included in the wellhead assembly 10 of FIG. 1 is a string of production tubing 30 with an upper end connected to the tubing hanger 28 and which extends into wellbore 12. Tubing spool 26 is on a casing spool 32 having a casing hanger 34 for supporting a string of casing 36, which also extends into wellbore 12 and circumscribes tubing 30. In the example of FIG. 1, a casing spool 32 mounts onto a lower spool 38 which is shown resting on a surface 40 above formation 14.

Fracturing system 17 also includes an annular isolation sleeve 42 shown coupled within the fracturing spool 18 and which depends downward and coaxially inserts within tubing hanger 28. An optional centralizing ring 43 is shown coaxially inserted between isolation sleeve 42 and fracturing spool 18. In one example, isolation sleeve 42 shields portions of wellhead assembly 10 from abrasion and/or pressure of fracturing fluid, which can damage selected components in those portions. Examples of selected components include elements in the production valve body 22 and threaded surfaces in the wellhead assembly 10. Additionally, upper lockdown screws 44 are shown provided within passages 45 that extend radially through the body of the fracturing spool 18. Lockdown screws 44 have an inner radial end that projects within the body of fracturing spool 18 and selectively exerts an axial downward force onto the isolation sleeve 42 to secure isolation sleeve 42 within main bore 25. Also shown in FIG. 1 are anti-rotation screws 46 that extend through lateral passages 47 in the fracturing spool 18. As will be described in more detail below, an inner radial end of the anti-rotation screws 46 rotational affixes isolation sleeve 42 within fracturing spool 18.

Figure 2:
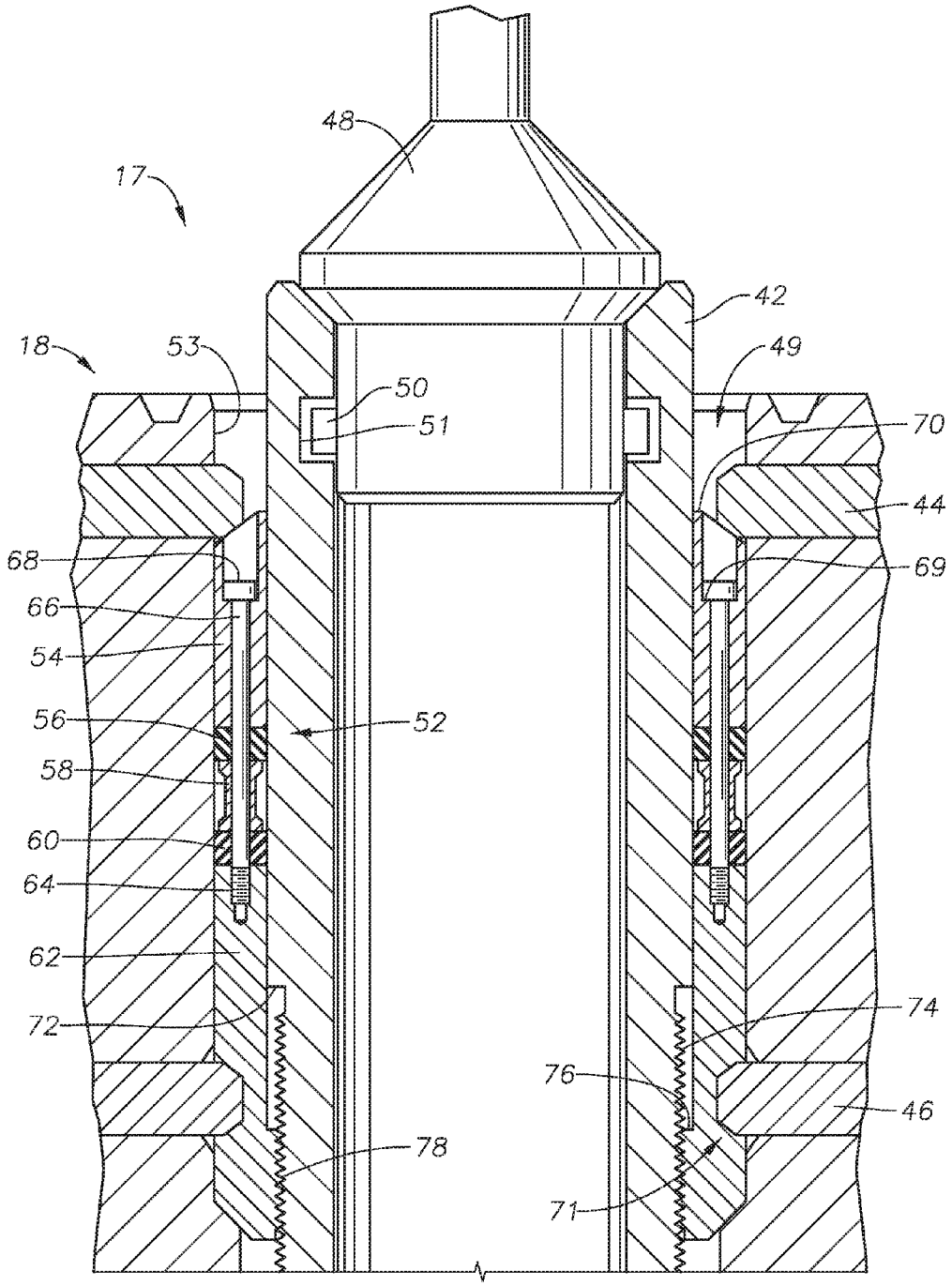
FIG. 2 is sectional view of an example of an upper portion of the fracturing system of FIG. 1 in accordance with an embodiment of the present invention.

FIG. 2 is an enlarged view of a portion of hectoring spool 18 and upper end of isolation sleeve 42. In this example, a running tool 48 is shown coupled to an upper end of isolation sleeve 42 and is optionally provided as a means for inserting isolation sleeve 42 within an axial bore 49 formed in fracturing spool 18. A J-Lug 50 projects radially outward from a running tool 48 and into a slot 51 formed in an inner circumference of isolation sleeve 42 and dimensioned to receive the J-Lug 50. In embodiments where the J-Lug 50 does not retract, slot 51 may extend a portion along the circumference of inner surface of isolation sleeve 42 then axially along inner surface of isolation sleeve 42.

An example of an annular seal assembly 52 is coaxially disposed in an annular space between isolation sleeve 42 and inner surface 53 of fracturing spool 18. In the example shown, seal assembly 52 includes an annular compression ring 54 which stacks on an upper compression seal 56. Upper compression seal 56, in one example, includes material made from an elastomer so that when axially compressed seal 56 radially expands to form a flow and pressure barrier in the annular space between isolation sleeve 42 and fracturing spool 18. Seal assembly 52 further includes an annular spacer 58 shown underneath upper compression seal 56 and a lower compression seal 60 on an end of spacer 58 distal from upper compression seal 56. On the lower end of seal assembly 52 is an annual load ring 62, shown having holes 64 in which threaded ends of retainer screws 66 are threadingly inserted. Retainer screws 66 have head portions 68 with an enlarged diameter that are shown set within a slot axially formed in an upper end of compression ring 54. The width of the slots reduces to define shoulders 69 that are in interfering contact with lower surfaces of the head portions 68. Accordingly, tightening or loosening retainer screws 66 can radially expand or relax the upper and lower compression seals 56, 60 so that selective sealing can take place between isolation sleeve 42 and inner circumference of the bore in the fracturing spool 18.

Still referring to FIG. 2, an upper terminal end 70 of compression ring 54 depends downward with distance radially outward, so that the lockdown screws 44 engage the compression ring 54 along an oblique surface. Optionally, adjusting the depth of insertion of lockdown screws 44 axially adjusts placement of the seal assembly 52 within the fracturing spool 18. Similarly, grooves 71 are formed on an outer circumference of the load ring 62 and strategically located to receive inner ends of the anti-rotation screws 46. In an example, the grooves 72 are selectively positioned and dimensioned to register with the inner ends of the anti-rotation screws 46, and thereby rotationally affix isolation sleeve 42 to fracturing spool 18 when engaged by ends of anti-rotation screws 46. At a designated axial location, the outer surface of isolation sleeve 42 projects radially inward to define a downward facing shoulder 72. Threads 74 are shown formed along a portion of the outer circumference of isolation sleeve 42 and below the shoulder 72. In the example of FIG. 2, the threads 74 project past a lower end of load ring 62. An inner circumference of load ring 62, distal from hole 64, projects radially inward and defines an upward facing shoulder 76. Threads 78 are shown on the inner circumference of load ring 62 and in the region past shoulder 76.

Figure 3:
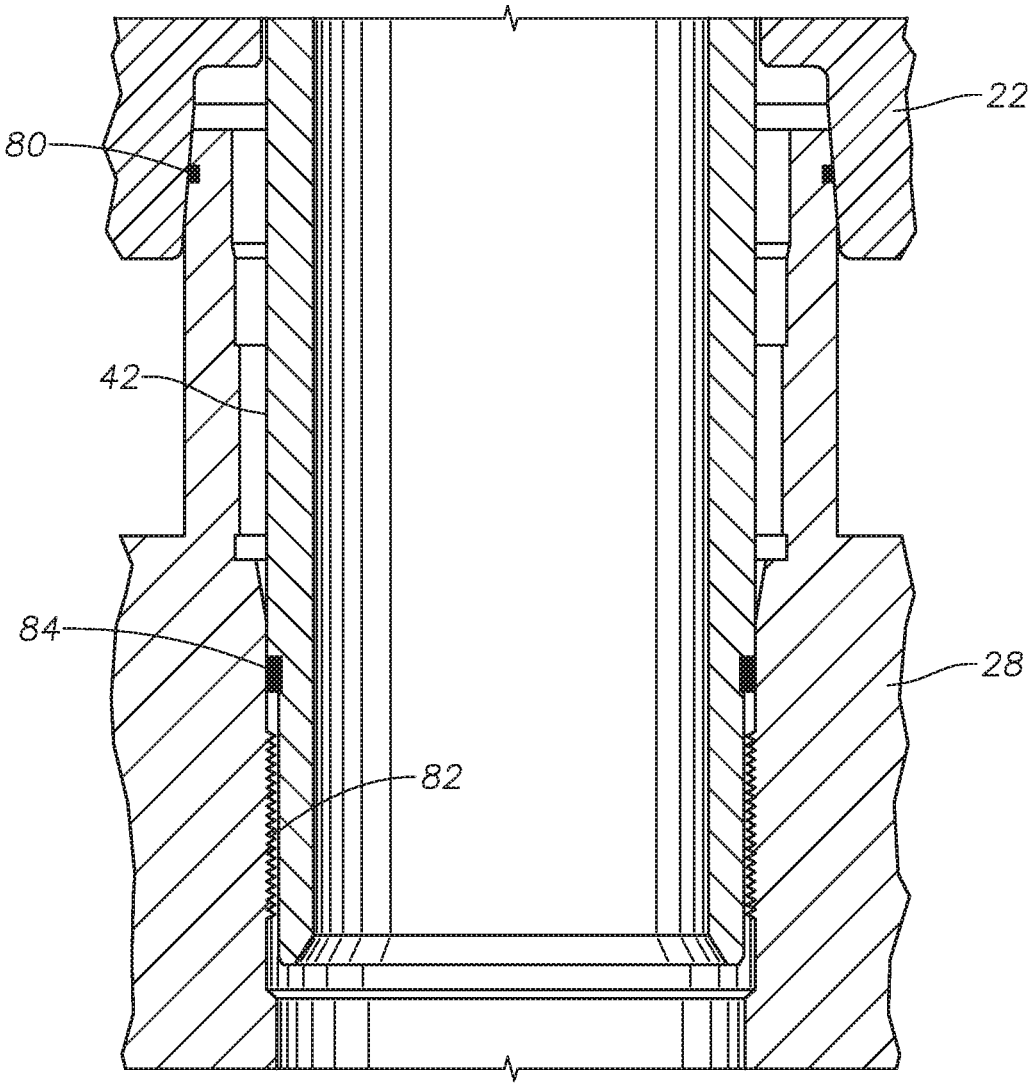
FIG. 3 is sectional view of an example of a lower portion of the fracturing system of FIG. 1 in accordance with an embodiment of the present invention.

Referring now to FIG. 3, shown is a side sectional view of a lower portion of isolation sleeve 42 coaxially inserted within tubing hanger 28. Further shown in this example is an optional seal 80 set between an outer circumference of tubing hanger 28 and inner surface of valve body 22. Additionally illustrated in this example are threads 82 on the inner circumference of tubing hanger 28 and adjacent an outer surface of isolation sleeve 42. Threads 82 are also shielded by isolation sleeve 42 front fracturing fluid in the wellhead assembly 10. In the example of FIG. 3, an optional seal 84 on the outer surface of isolation sleeve 42 defines a flow barrier between isolation sleeve 42 and inner surface of tubing hanger 28 and above threads 82.

In one example of operation, isolation sleeve 42 is inserted into fracturing spool 18 with running tool 48 (FIG. 2). Seal assembly 52 is axially and regionally anchored within fracturing spool 18 by inserting screws 44, 46 info respective passages 45, 47. In the example of FIG. 1 by virtue of the connection between threads 74, 78 a lower end of isolation sleeve 42 is positioned at a designated axial position in fracturing spool 18, which is illustrated as a distance $Y_1$ from an upper end of fracturing spool 18. Further in this example, when threads 74, 78 are engaged, rotating the isolation sleeve 42 selectively adjusts its axial position in the fracturing spool 18. As such, isolation sleeve 42 can be raised or lowered so that the lower end (FIG. 3) selectively shrouds portions of the wellhead assembly 10. In the embodiment of FIG. 3, isolation sleeve 42 does not engage threads 82.

Figure 4:
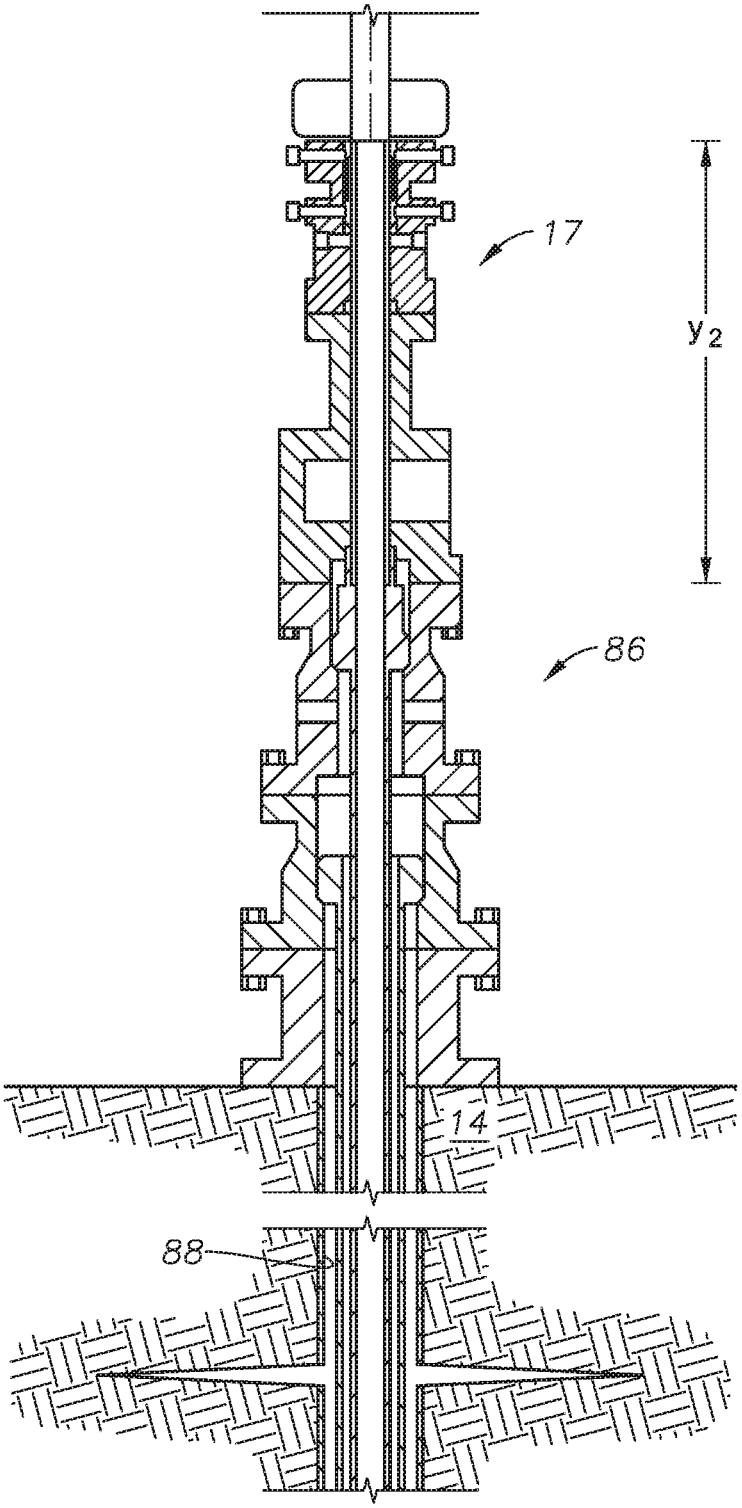
FIG. 4 is a side sectional view of the fracturing system of FIG. 1 mounted onto a different wellhead assembly, and in accordance with an embodiment of the present invention.

Referring now to FIG. 4, the fracturing system 17 is shown on a wellhead assembly 86 mounted over a wellhead 88, where wellhead assembly 10 and wellhead assembly 86 have components at different axial locations. As shown, the lower end of isolation sleeve 42 is a distance $Y_2$ from the upper end of fracturing spool 18, where distance $Y_2$ is different than distance $Y_1$. Thus the axial adjustability of isolation sleeve 42 allows the fracturing assembly 17 to be set on wellhead assembly 86, having axial dimensions different from wellhead assembly 10, and yet still protect components within wellhead assembly 86. Fracturing systems with isolation sleeves that are not readily adjustable are not effective in wellhead assemblies having components spaced apart at different depths or axial locations. Thus, when removed from the wellhead assembly 10 of FIG. 1 and positioned on wellhead assembly 86 of FIG. 4, the axial location of isolation sleeve 42 is readily adjustable to protect components at different axial locations than those of wellhead assembly 10.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A fracturing assembly for use with a wellhead assembly comprising:

a fracturing spool that is selectively mounted onto the wellhead assembly;

a seal assembly axially supported in an axial bore in the fracturing spool; and an isolation sleeve comprising an end in selective communication with a supply of fracturing fluid, a portion that extends into a main bore of the wellhead assembly and defines a barrier between the fracturing fluid and components in the wellhead assembly, and an outer surface with a threaded portion that engages threads on an inner surface of a load ring of the seal assembly, the load ring supporting the isolation sleeve within the wellhead assembly and the threaded portion having a length so that the isolation sleeve is adjustable to axial locations within the main bore by a rotation of the isolation sleeve relative to the load ring.

2. The fracturing assembly of claim 1, further comprising an anti-rotation screw radially disposed through a sidewall of the fracturing spool and having an end inserted into a groove formed in an outer surface of the seal assembly, so that the seal assembly is rotationally affixed to the fracturing spool.

3. The fracturing assembly of claim 2, further comprising a lockdown screw radially disposed through a sidewall of the fracturing spool and in contact with an end of the seal assembly distal from the groove and that exerts a force onto the seal assembly directed towards the groove.

4. The fracturing assembly of claim 1, wherein the seal assembly further includes an annular elastic compression seal stacked onto the load ring, an annular compression ring stacked onto the compression seal, passages formed axially in sidewalls of the load ring, compression seal and compression ring, fasteners inserted into the passages and that each have a lower end threaded into the load ring and an upper end in interfering contact with the compression ring.

5. The fracturing assembly of claim 1, wherein the wellhead assembly comprises a first wellhead assembly, and wherein the fracturing spool is selectively mounted on a second wellhead assembly having components at axial locations different from axial locations of components of the first wellhead assembly, and wherein the isolation sleeve is selectively repositioned by rotation and isolates the components in the second wellhead assembly from the fracturing fluid.

6. The fracturing assembly of claim 1, wherein the wellhead assembly comprises a production valve mounted on a tubing spool, and wherein the isolation sleeve extends through the production valve and into the tubing spool.

7. The fracturing assembly of claim 6, wherein the isolation sleeve extends past threads in the tubing spool and thereby defines a barrier between the fracturing fluid and the threads in the tubing spool.

8. The fracturing assembly of claim 1, wherein the wellhead assembly includes a tubing hanger, and wherein the isolation sleeve extends into the tubing hanger and sealingly engages and inner diameter of the tubing hanger.

9. The fracturing assembly of claim 1, wherein the isolation sleeve extends through the seal assembly, with a portion of the isolation sleeve located beyond each end of the seal assembly.

10. A fracturing assembly for use with wellhead assemblies comprising:

a fracturing spool that selectively mounts onto the wellhead assemblies and has an axial bore that registers with main bores in each of the wellhead assemblies;

an isolation sleeve in the fracturing spool to isolate fracturing fluid in the isolation sleeve from selected components at an axial location in a one of the wellhead assemblies, and that is adjustable to isolate the fracturing fluid from selected components in another one of the wellhead assemblies and that is at a different axial location; and a seal assembly disposed the axial bore in the fracturing spool, wherein the isolation sleeve has an outer surface with a threaded portion that engages threads on an inner surface of the seal assembly and having a length so that the isolation sleeve is adjustable to axial locations within the main bore, and wherein the seal assembly further includes an annular elastic compression seal stacked onto a load ring, an annular compression ring stacked onto the compression seal, passages formed axially in sidewalls of the load ring, compression seal and compression ring, fasteners inserted into the passages and that each have a lower end threaded into the load ring and an upper end in interfering contact with the compression ring.

11. The fracturing assembly of claim 10, further comprising anti-rotation screws in the fracturing spool for rotationally anchoring the isolation sleeve to the fracturing spool.

12. A method of fracturing a well comprising:

providing a supply of fracturing fluid to a wellhead assembly mounted onto the well;

landing a seal assembly in an axial bore in the fracturing spool, the seal assembly being axially supported by a shoulder of the fracturing spool, the seal assembly having a load ring with threads on an inner surface of the load ring;

inserting an isolation sleeve into a main bore of the wellhead assembly to isolate components in the wellhead assembly from the fracturing fluid, the isolation sleeve being axially supported by the load ring and having an outer surface with a threaded portion that engages the threads of the load ring; and adjusting an axial position of the isolation sleeve within the main bore by rotating the isolation sleeve relative to the load ring.

13. The method of claim 12, wherein the wellhead assembly comprises a first wellhead assembly, the method further comprising inserting the isolation sleeve into a second wellhead assembly having components that are lower than the components in the first wellhead assembly, and adjusting the axial position of the isolation sleeve within a main bore of the second wellhead assembly to isolate the components in the second wellhead assembly from the fracturing fluid.

14. The method of claim 12, wherein the isolation sleeve is in a fracturing spool that is mounted onto the wellhead assembly, and wherein a seal is between the isolation sleeve and the fracturing spool.

* * * * *